US006679142B1

(12) United States Patent
Lin

(10) Patent No.: US 6,679,142 B1
(45) Date of Patent: Jan. 20, 2004

(54) SPOKE WRENCH FOR A BICYCLE

(76) Inventor: Shyh-Jye Lin, No. 6, Lane 99, Yung Shing Rd., Da Li City, Taichung Hsien (TW)

( * ) Notice: Subject to any disclaimer, the term of this patent is extended or adjusted under 35 U.S.C. 154(b) by 0 days.

(21) Appl. No.: 10/366,268

(22) Filed: Feb. 13, 2003

(51) Int. Cl.[7] ..... B25F 1/00

(52) U.S. Cl. ..... 81/437; 81/438; 81/439; 81/177.4; 81/490; 7/165; 7/138; 7/100

(58) Field of Search ..... 81/437, 438, 439, 81/177.4, 490; 7/165, 138, 100

(56) References Cited

U.S. PATENT DOCUMENTS 395,598 A * 1/1889 Waggoner ..... 7/138
1,321,625 A * 11/1919 Grover ..... 7/138
4,967,435 A * 11/1990 Seals ..... 7/139
5,086,674 A * 2/1992 Her ..... 81/124.4
5,313,860 A * 5/1994 Liou ..... 81/437
5,544,379 A * 8/1996 Chen ..... 7/138
5,655,242 A * 8/1997 Chuang ..... 7/138
5,894,767 A * 4/1999 Wridt et al. ..... 81/119
6,062,111 A * 5/2000 Wershe ..... 81/177.4
6,279,434 B1 * 8/2001 Brown ..... 81/437
6,336,385 B1 * 1/2002 Wang ..... 81/177.4
6,418,821 B1 * 7/2002 Yamakawa ..... 81/437
6,574,817 B2 * 6/2003 Wu ..... 7/138

* cited by examiner

*Primary Examiner*—Joseph J. Hail, III
*Assistant Examiner*—Alvin J. Grant
(74) *Attorney, Agent, or Firm*—Charles E. Baxley

(57) ABSTRACT

A spoke wrench for a bicycle comprises a body, at least two driving members and a screwdriver bit. The body includes a driving seat having a slide way formed therein. A slot way is integrally formed on the body. The body has at least one depression for engaging with the driving member. A positioning portion which is integrally formed with the body has a receiving chamber, a opening is formed through the positioning portion for communicating with the receiving chamber, a steel ball is then retractably defined in the opening of the positioning portion. At least two driving members are detachably received in the slide way of the driving seat and the depressions of the body. A screwdriver bit is detachably received in the receiving chamber of the positioning portion of the body for engaging with a workpiece to tighten or loosen it.

9 Claims, 6 Drawing Sheets

SPOKE WRENCH FOR A BICYCLE

FIELD OF THE INVENTION

The present invention relates to a wrench, and more particularly to a wrench for engaging the nipple of a bicycle wheel spoke, commonly known as "a spoke wrench".

BACKGROUND OF THE INVENTION

Spoke wrenches having engaging notches to tighten or loosen bicycle spoke nipples have previously been provided. These prior spoke wrenches are inadequate because they usually have only one size engaging notch, thereby requiring a different spoke wrench for each different size of spoke nipple. Furthermore, these spoke wrenches have just one function and can only be used for dismantling or reassembling spokes of the bicycle. That is, they were made to perform similar functions and were not able to perform multiple functions at once as a tool. As a result, to work in the field of industry or at home, various kinds of tools needs to be prepared, sorted separately, and looked for whenever necessary, which delayed work speed and therefore caused lower efficiency.

The present invention mitigates and/or obviates the afore-described disadvantages of the conventional spoke wrench for a bicycle.

SUMMARY OF THE INVENTION

In accordance with the present invention, there is provided a spoke wrench for a bicycle, which has a slot formed thereof for receiving driving members and has no less than two recesses defined therein for receiving driving members, the driving members are different sized, can-be-dismantled received in the notch and changeable for applicable purposes, in addition, a passage is defined in the spoke wrench for receiving heads of screw driver therein.

The primary object of the present invention is to provide a spoke wrench for a bicycle, which can be used to engage several different sized spoke nipples.

Another object of the present invention is to provide a spoke wrench for a bicycle, which can improve the work efficiency by adding a screwdriver bit so that it can have two functions. Therefore, the spoke wrench does all the work, saving the trouble of keeping each tool in separate places and searching for each of them whenever needed.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
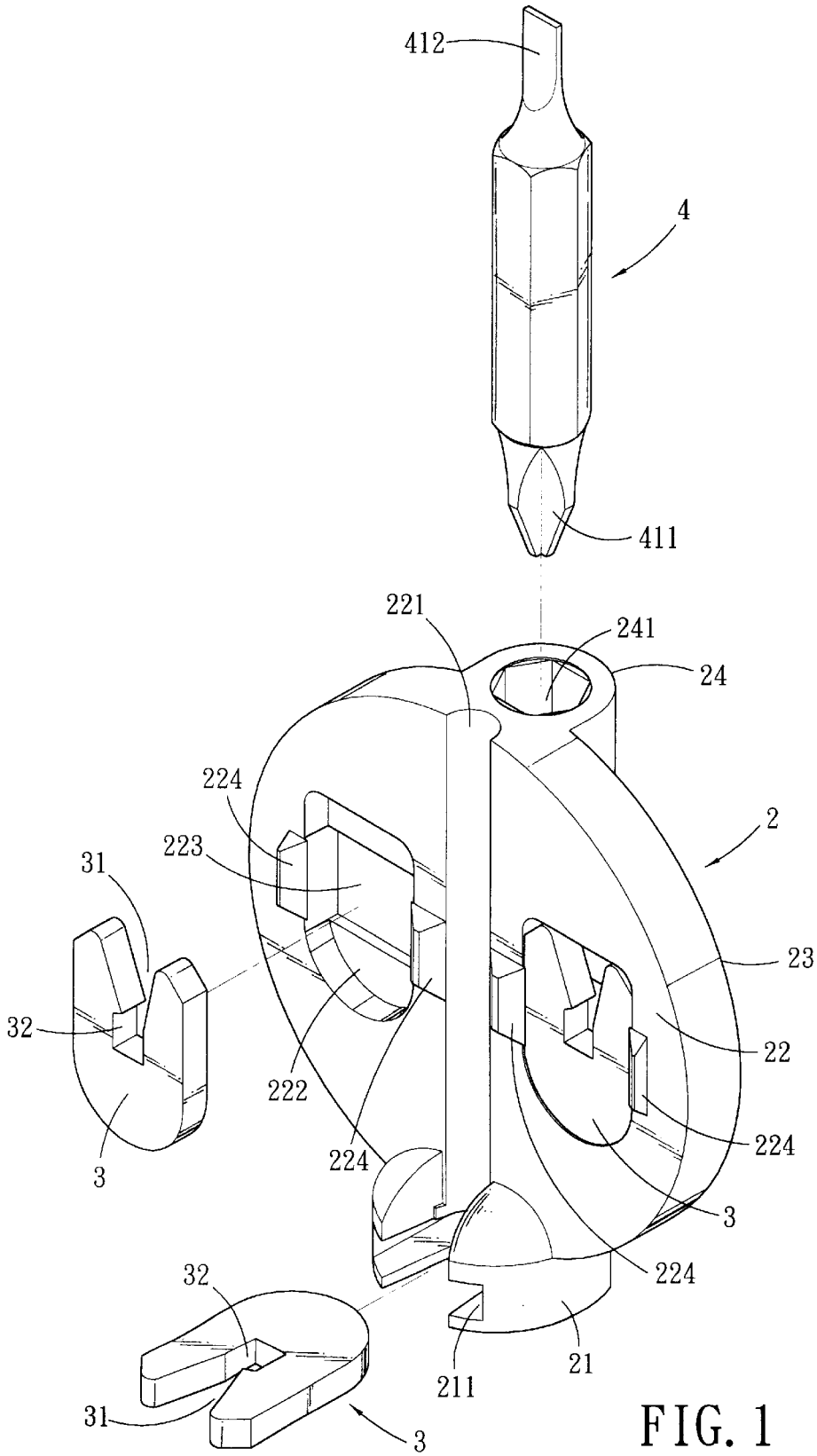
FIG. 1 is an exploded view of a spoke wrench in accordance with the present invention.
Figure 2:
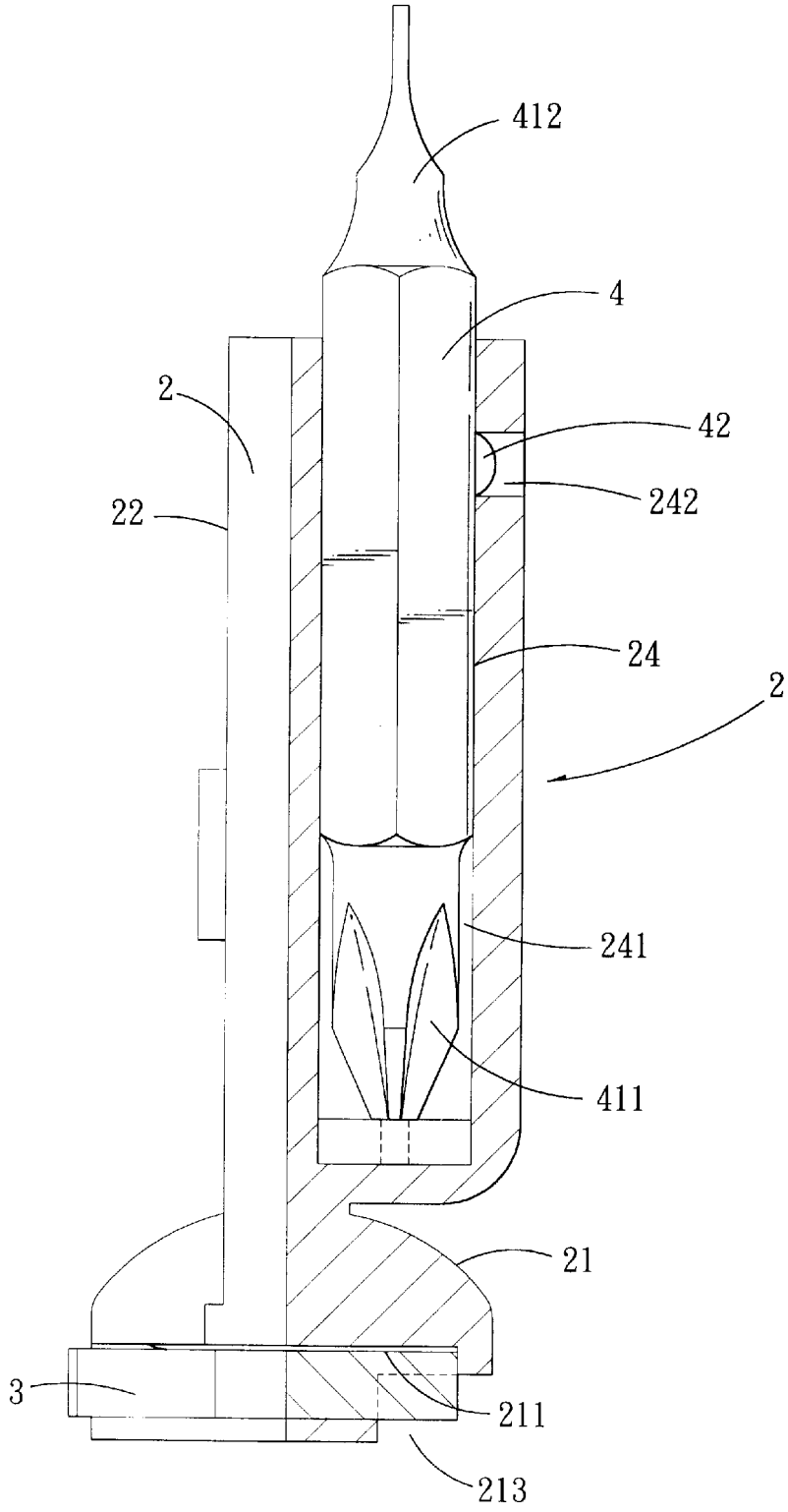
FIG. 2 is a plan cross sectional assembly view of the present invention.

Referring to FIGS. 1 to 2, a spoke wrench in accordance with the present invention comprises a body 2, at least two driving members 3 and a screwdriver bit 4. The body 2 includes a driving seat 21 having a slide way 211 formed therein, a first face 22 located above the driving seat 21 and a second face 23 which is opposed to the first face 22. A slot way 221 is integrally formed on the first face 22, thereby separating the first face 22 into two port ions by means of the slot way 221, and each of the two portions has a depression 222 (there can be have several depressions as needed according to the present invention) formed thereon for engaging with each of the driving member 3. The depression 222 has a through hole 223 for communicating with the second face 23 of the body 2 and is formed with two protrusions 224 which is made from soft material at both sides of the through hole 223 thereof for firmly holding each of the driving member 3.The body 2 is preferably made as a unitary structure.

Figure 3:
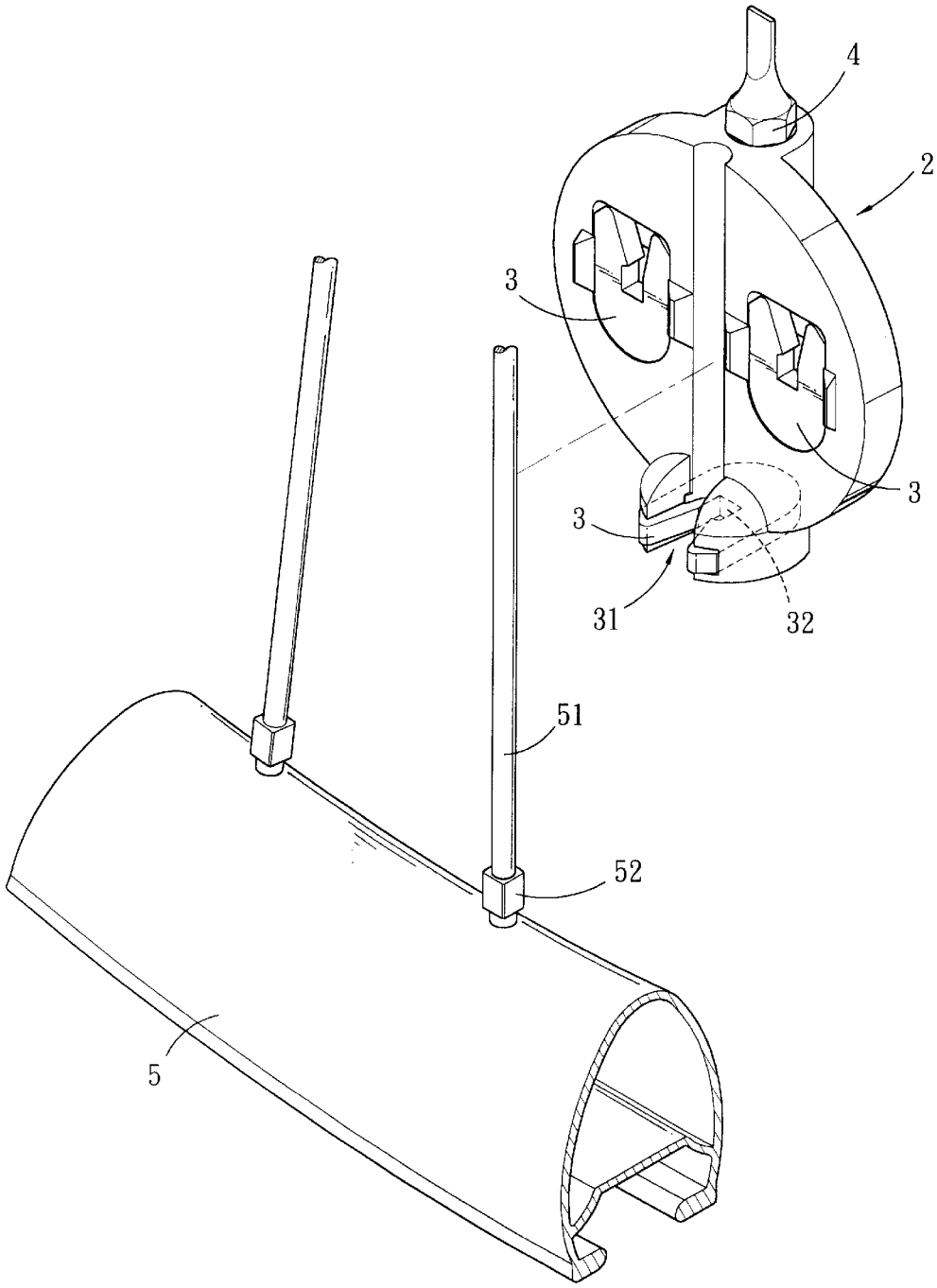
FIG. 3 is a perspective view of a spoke wrench in accordance with the present invention, wherein the spoke wrench is in a ready position.
Figure 4:
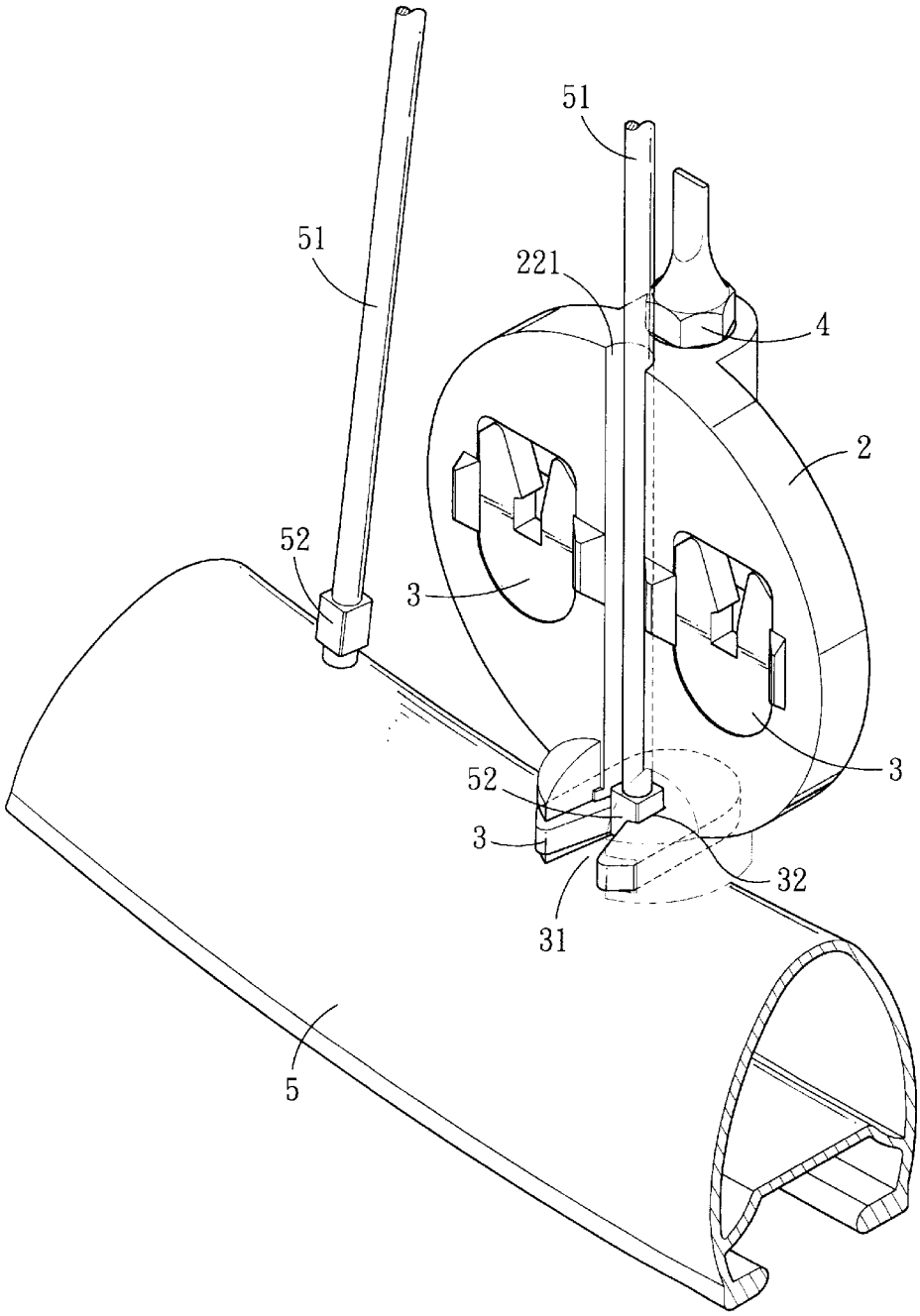
FIG. 4 is a perspective view of a spoke wrench in accordance with the present invention, wherein the spoke wrench is engaged with a bicycle spoke nipple.

Each of the driving members 3 is detachably received in the slide way 211 of the driving seat 21 and the depressions 222 of the body 2, and has a passage 31 formed thereon for allowing a spoke 51 of a bicycle wheel to pass therethrough, as shown in FIG. 3. Each notch 32 is designed to engaged a bicycle nipple 52 in order to tighten or loosen (in a known fashion) a spoke 51 of a bicycle wheel 5, to which the spoke nipple 52 is connected, as shown in FIG. 4. In that regard, the notch 32 may have the same or different dimension, so that the notch 32 may each be dimensioned to engage the same or different size spoke nipples, thereby allowing the spoke wrench to be used with from one to several spoke nipples. A positioning portion 24 is integrally formed with the second face 23 of the body 2 and has a receiving chamber 241 which is hexagon in cross section for receiving the screwdriver bit 4, a opening 242 is formed through the positioning portion 24 for communicating with the receiving chamber 241. The screwdriver bit 4 is hexagon in cross section having two ends 411,412, one is a cross drive bit 411, the other is a slot driver bit 412 (which also can be a hexagon drive bit, double-cross drive bit or the like), so the spoke wrench is applied for multiple purposes besides dismantling and reassembling spokes. A steel ball 42 retractably defined in the shank of the screwdriver bit 4 is to be engaged in the opening 242 of the positioning portion 24, such that the screwdriver bit 4 can be inserted in the positioning portion 24 firmly without dropping out, however, will be easily disengaged from it by pushing the steel ball 42.

Figure 6:
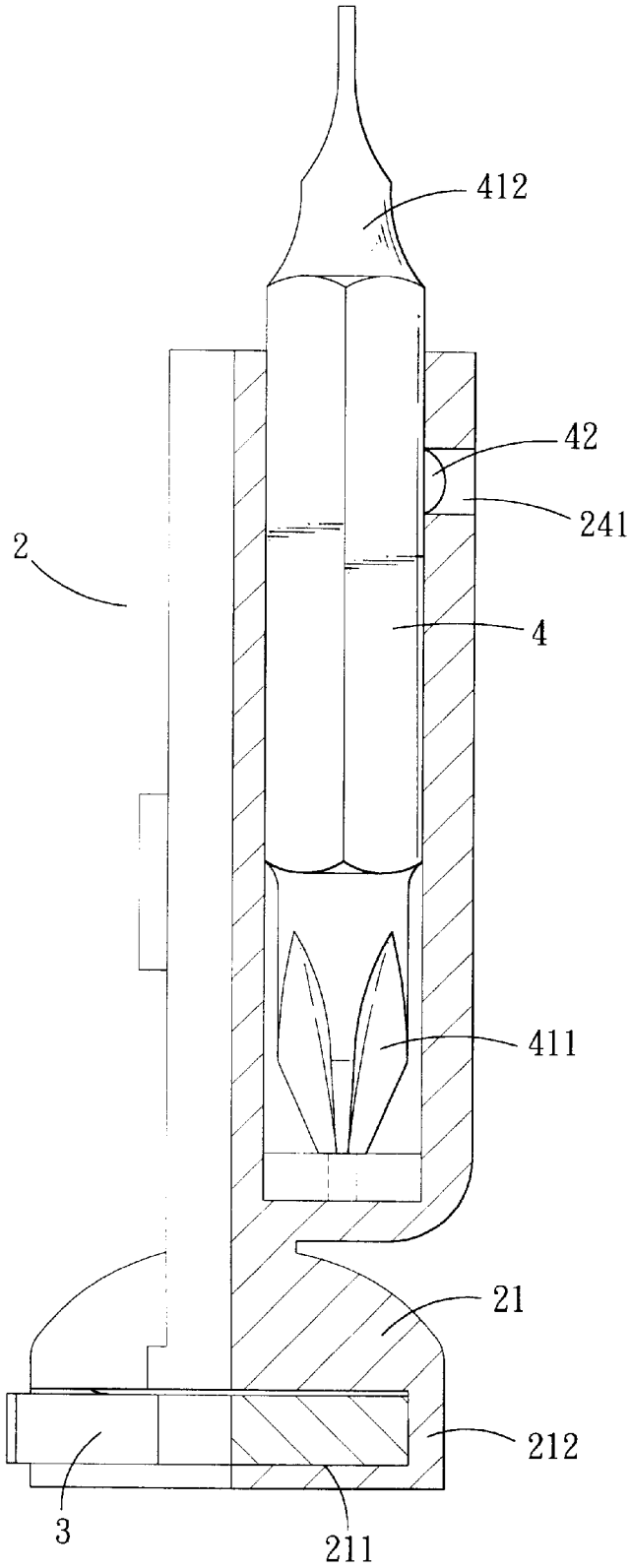
FIG. 6 is a plan cross sectional assembly view of the present invention, in which, the slide way of the driving seat has a closed end.

As shown in FIG. 6, the slide way 211 of the driving seat 21 may be has a closed end 212, as shown in FIG. 6.

Figure 5:
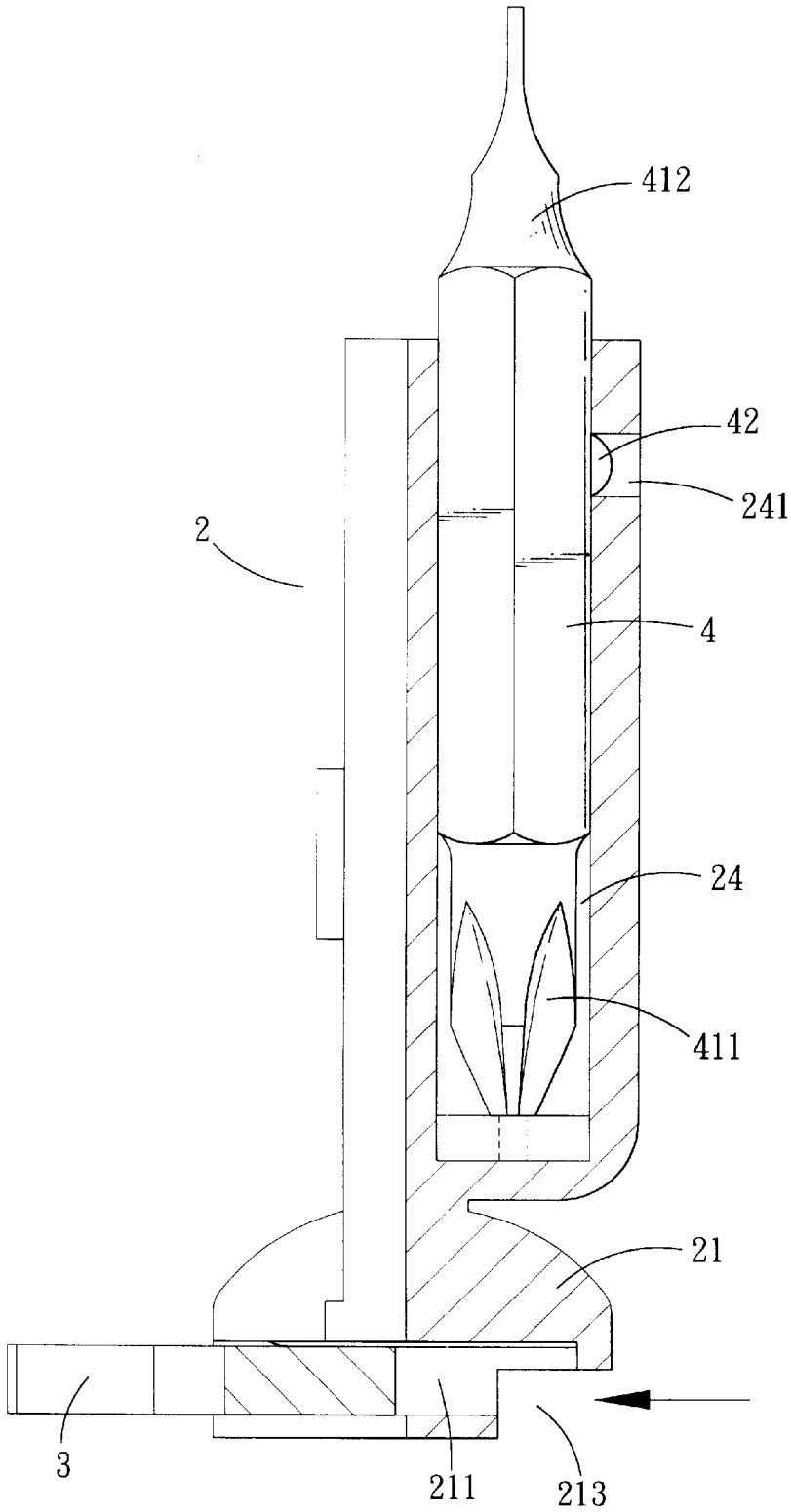
FIG. 5 is a plan cross sectional assembly view of a spoke wrench according to the present invention, wherein a driving member is pushed out.

Referring further to FIG. 5, in which, the slide way 211 of the driving seat 21 of the body 2 is formed as a through hole so that the driving member 3 can be easily pushed out via a opened end 213. Furthermore, as shown in FIG. 1, each of the depressions 222 has a through hole 223 formed thereon so as to easily take the driving member 3 out from the depression 222.

The spoke wrench may be used as follow: As seen in FIG. 4, the correct size notch 32 is engaged with the spoke nipple 52. Since the slot way 221 lies substantially in axial alignment with the notch 32, the spoke 51 of a bicycle wheel 5 can be disposed within the slot way 221 and thereby not interfere with the use of the spoke wrench. The disposal of the spoke nipple 52 within the notch 32 also aids in maintaining the axis of the body 2 in generally alignment with the spoke nipple 52 to facilitate use of the spoke wrench and to maintain engagement between the notch 32 and the spoke nipple 52.

While we have shown and described the embodiments in accordance with the present invention, it should be clear to those skilled in the art that further embodiments may be made without departing from the scope of the present invention.

What is claimed is:

1. A spoke wrench for a bicycle comprising:

a body including a driving seat having a slide way formed therein, a first face located above the driving seat and a second face which is opposed to the first face, a slot way integrally formed on the first face for separating the first face into two portions by means of the slot way, and each of the two portions having a depression, a positioning portion integrally formed with the second face of the body, the positioning portion having a receiving chamber which is hexagon in cross section;

at least two driving members each detachably received in the slide way of the driving seat and the depressions of the body, said at least two driving members each having a passage and a notch formed thereon for allowing a spoke of a bicycle wheel to pass therethrough and a spoke nipple to locate therein;

a screwdriver bit detachably received in the receiving chamber of the positioning portion of the body, the screwdriver bit being hexagonal in cross section having two ends for engaging with a workpiece to tighten or loosen said workpiece.

2. The spoke wrench for a bicycle as claimed in claim 1, wherein the slide way of the driving seat has a closed end.

3. The spoke wrench for a bicycle as claimed in claim 1, wherein the slide way of the driving seat is a through hole so as to push out the driving member via a end of the slide way.

4. The spoke wrench for a bicycle as claimed in claim 1, wherein the depressions each has two protrusions made from soft material defined at both sides of the opening thereof for facilitating firmly hold the driving member.

5. The spoke wrench for a bicycle as claimed in claim 1, wherein each of the depressions has a through hole formed thereon for communicating with the second face of the body so as to take the driving member therefrom.

6. The spoke wrench for a bicycle as claimed in claim 1, wherein an opening is formed through the positioning portion for communicating with the receiving chamber, a steel ball is retractably defined in the shank of the screwdriver bit for engaging with the opening of the positioning portion.

7. The spoke wrench for a bicycle as claimed in claim 1, wherein the two ends of the screwdriver bit each has a different type of driver bit.

8. The spoke wrench for a bicycle as claimed in claim 7, wherein the two ends of the screwdriver bit, one is a cross drive bit, the other is a slot driver bit.

9. The spoke wrench for a bicycle as claimed in claim 7, wherein the two ends of the screwdriver bit, one is a double-cross drive bit, the other is a hexagonal driver bit.

* * * * *